US005544626A

United States Patent [19]

Diggs et al.

[11] Patent Number: 5,544,626

[45] Date of Patent: Aug. 13, 1996

[54] FINGER FOLLOWER ROCKER ARM WITH ENGINE VALVE DEACTIVATOR

[75] Inventors: Matthew B. Diggs, Farmington; Gordon W. Sweetnam, Milford, both of Mich.

[73] Assignee: Ford Motor Company, Dearborn, Mich.

[21] Appl. No.: 401,372

[22] Filed: Mar. 9, 1995

[51] Int. Cl.[6] ..... F01L 13/00; F02D 13/06

[52] U.S. Cl. ..... 123/90.16; 123/90.41; 123/198 F

[58] Field of Search ..... 123/90.15, 90.16, 123/90.27, 90.39, 90.41, 90.42, 90.43, 90.44, 90.45, 90.46, 90.36, 198 F

[56] References Cited

U.S. PATENT DOCUMENTS

| | | | |
|---|---|---|---|
| Re. 33,310 | 8/1990 | Ajiki et al. | 123/90.16 |
| Re. 33,411 | 10/1990 | Inoue et al. | 123/90.16 |
| 4,151,817 | 5/1979 | Mueller | 123/90.16 |
| 4,523,550 | 6/1985 | Matsuura | 123/90.16 |
| 4,537,165 | 8/1985 | Honda et al. | 123/90.16 |
| 4,576,128 | 3/1986 | Kenichi | 123/90.16 |
| 4,607,600 | 8/1986 | Yoshizaki | 123/198 F |
| 4,611,558 | 9/1986 | Yoshizaki et al. | 123/90.16 |
| 4,617,880 | 10/1986 | Yoshizaki | 123/90.16 |
| 4,656,977 | 4/1987 | Nagahiro et al. | 123/90.16 |
| 4,727,830 | 3/1988 | Nagahiro et al. | 123/90.16 |
| 4,727,831 | 3/1988 | Nagahiro et al. | 123/90.16 |
| 4,741,297 | 5/1988 | Nagahiro et al. | 123/90.16 |
| 4,759,322 | 7/1988 | Konno | 123/90.16 |
| 4,768,467 | 9/1988 | Yamada et al. | 123/90.16 |
| 4,777,914 | 10/1988 | Konno | 123/90.16 |
| 4,787,346 | 11/1988 | Asjiki et al. | 123/90.16 |
| 4,788,946 | 12/1988 | Inoue et al. | 123/90.16 |
| 4,793,296 | 12/1988 | Inoue et al. | 123/90.16 |
| 4,799,463 | 1/1989 | Konno | 123/90.16 |
| 4,829,948 | 5/1989 | Yoshida et al. | 123/90.16 |
| 4,844,023 | 7/1989 | Konno et al. | 123/90.16 |
| 4,848,285 | 7/1989 | Konno | 123/90.16 |
| 4,869,214 | 9/1989 | Inoue et al. | 123/90.16 |
| 4,883,027 | 11/1989 | Oikawa et al. | 123/90.16 |
| 4,887,563 | 12/1989 | Ishida et al. | 123/90.16 |
| 4,905,639 | 3/1990 | Konno | 123/90.16 |
| 4,907,550 | 3/1990 | Inoue et al. | 123/90.16 |
| 4,909,195 | 3/1990 | Hasebe et al. | 123/90.16 |
| 4,911,112 | 3/1990 | Oikawa et al. | 123/90.16 |
| 4,911,114 | 3/1990 | Konno et al. | 123/90.16 |
| 4,926,804 | 5/1990 | Fukuo | 123/90.16 |
| 4,942,853 | 7/1990 | Konno | 123/90.16 |
| 5,048,475 | 9/1991 | Mills | 123/90.41 |
| 5,239,952 | 8/1993 | Morita | 123/90.16 |
| 5,251,586 | 10/1993 | Koga et al. | 123/90.16 |

*Primary Examiner*—Weilun Lo
*Attorney, Agent, or Firm*—Jerome R. Drouillard

[57] ABSTRACT

A finger follower type rocker arm has an outer body that engages the stem of an engine valve. Within the body is pivotally mounted an inner arm engaged and moved by the cam lobe of an engine camshaft. A latching pin normally causes the inner arm and outer body to act as an integral unit to activate the engine valve in a conventional manner. Selective withdrawal of the latching pin permits the cam lobe to move the inner arm in a free-wheeling manner without effecting movement of the outer body or valve stem, thus disabling the engine valve.

6 Claims, 3 Drawing Sheets

FINGER FOLLOWER ROCKER ARM WITH ENGINE VALVE DEACTIVATOR

FIELD OF THE INVENTION

This invention relates in general to an engine valvetrain, and, more particularly, to a finger follower rocker arm design.

BACKGROUND OF THE INVENTION

Devices are known for deactivating one or more engine valves at times during lower engine power requirements to provide fuel economy. These take several forms. For example, one known design utilizes a zero lift cam lobe that can be made operative to deactivate a particular valve or valves when desired. Another type utilizes a sliding sleeve assembly and different pad members for selectively deactivating a particular valve. A third type uses several cams to actuate a number of valves, one cam lobe being higher than others and activated when desired to disable the operation of a pair of valves. Another construction uses locking pins in cooperation with low and high speed rocker arms in side-by-side relationship to disable particular engine valves. None of the above designs provides a finger follower rocker arm construction having valve deactivation means wholly contained within the rocker arm, and one which simply can be substituted for a conventional finger follower type rocker arm to provide activation or deactivation of its associated engine valve as desired.

The prior art valve deactivating designs are not the integral type replacements for conventional roller finger follower rocker arms, are more complicated and expensive to manufacture, and generally require much more precise machining procedures.

SUMMARY OF THE INVENTION

The invention provides a finger follower type rocker arm with a self-contained valve disabler or deactivator. It consists of an outer body that engages the valve stem, and an inner arm pivotally mounted on and within the outer body for movement relative to the outer body. The inner arm is spring biased upwardly against an engine camshaft cam lobe to be pivoted by it.

A latching means within the outer body normally is in a position to limit movement of the inner arm relative to the outer body so that the cam lobe can pivot the outer body and inner arm together as an integral unit to actuate the valve stem.

Withdrawal of the latching means permits the inner arm to free-wheel in a lost motion manner without causing a movement of the outer body or valve stem.

The design of the rocker arm with deactivator permits it to be easily substituted as an integral unit for a conventional finger follower rocker arm merely by dropping the one in place of the other.

It is a primary object of the invention, therefore, to provide a finger follower type rocker arm construction with a valve deactivating means self-contained therein for disabling the engine valve at times, coupled with means for reactivating the rocker arm to permit actuation of the engine valve in a conventional manner.

It is a further object of the invention to provide a finger follower type rocker arm that contains selectively operable engine valve disabling means integral with the rocker arm, the integral construction allowing it to replace a conventional finger follower rocker arm merely by exchanging the one for the other.

Further objects, features and advantages of the invention will become more apparent upon reference to the succeeding, detailed description thereof, and to the drawings illustrating the preferred embodiments thereof.

DETAILED DESCRIPTION OF THE INVENTION

The invention is adapted for use in an automotive environment having engine finger follower type rocker arms. However, it will be clear that it would have a use in any engine in which there is a need for a simple construction for at times interrupting the operation of one or more rocker arm controlled engine valves without interfering with the normal operation of other valves.

Figure 1:
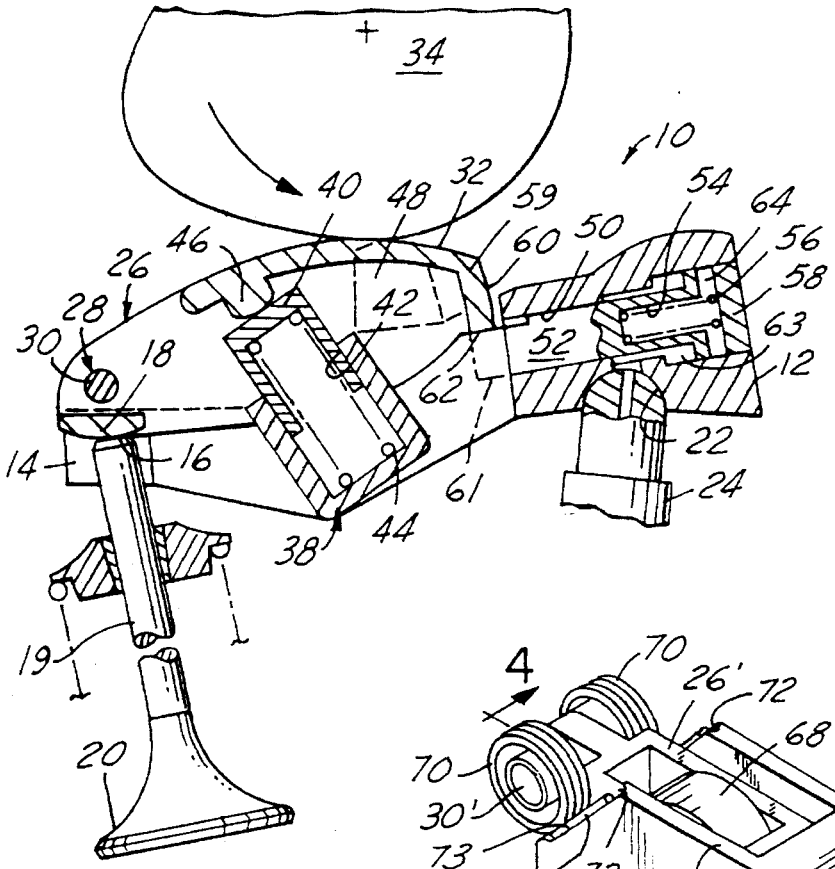
FIG. 1 is a cross-sectional view of a finger follower rocker arm embodying the invention.

FIG. 1 shows a finger follower type rocker arm 10 consisting of an outer body 12 that extends longitudinally to terminate in a hollow or yoke-shaped (not shown) portion 14. A socket or recess 16 contains an engine valve stem pad 18 engageable by the stem 19 of a conventional engine valve 20.

The opposite end of body 12 contains a spherical socket 22 receiving the plunger end portion of a hydraulic lash adjuster 24, only partially shown. The lash adjuster constitutes a stationary fulcrum for pivotal movement of body 12 of the rocker arm, in a manner to be described.

Rocker arm 10 contains an inner arm 26 nested within the yoke-shaped portion of body 12. It is pivotally mounted at 28 between and to the yoke-shaped end 14 of the outer body by means of a pivot pin 30. Arm 26 extends longitudinally within the outer body and towards the opposite end of body 12 terminating short thereof at the base of the body recess for pivotal arcuate movement relative to the outer body.

The arm has a follower pad 32 provided with a surface for sliding engagement with the cam lobe 34 fixed on a conventional engine camshaft, not shown. The arm 26 is biased into engagement with the cam lobe by a bucket type follower 38. It consists of a plunger 40 slidably receivable within a pocket 42 in outer body 12, and a spring 44 continually biasing the plunger against a bumper pad 46 formed on the underside of follower pad 32.

The details of construction and operation of lash adjuster 24 are not given since they are known and believed to be unnecessary for an understanding of the invention. Suffice it to say, however, that it would contain a spring together with oil pressure normally biasing the plunger outwardly with enough force on the outer body 12 to move it to compensate for any lash between the cam and rocker arm when the cam is on its base circle.

In this case, the force of spring 44 of bucket follower 38 is designed to be stronger than the force of the lash adjuster. This is to prevent any undesirable pump up of the adjuster when the cam is on its base circle that might interfere with the normal opening or closing operations of an engine valve. For this purpose, the outer body is provided with rubbing pads 48 that extend outwardly from body 12. The force of spring 44 forces the inner arm 26 counterclockwise against the cam, the lash adjuster spring and oil pressure pushing the outer body upwardly so that the bumper pad 48 also contacts the cam lobe.

Outer body portion 21 contains a stepped diameter bore 50 for receiving a locking pin or plunger 52. The plunger has a recess 54 at one end for receiving a spring 56 that is seated against the bore cover or plug 58 for biasing the pin leftwardly as seen in FIG. 1. The pin 52 is biased into the path of arcuate movement of inner arm 26 to prevent pivotal movement of the arm in a clockwise direction relative to body 12. This prevents a "free-wheel" movement of the inner arm relative to body 12, in effect locking the arm and body together for movement as an integral unit in a downward pivotal direction about the lash adjuster pivot center to open the engine valve.

The inner arm terminates in a turned-down end portion 59 having a cylindrical surface 60. The pin 52 is formed with a horizontal flat on its end 61 for a mating engagement with the flat underside 62 of arm end portion 59. This minimizes contact stresses between the two by allowing a slight sideways play of the arm, thus eliminating the need for precise thrust surfaces.

In normal operation, therefore, the unit 10 acts as a conventional rocker arm. Latching pin 52 is forced outwardly by spring 56 so that follower pad 32 and outer body 12 move downwardly together to open the engine valve, the bucket spring 44 returning the two upwardly as the cam moves towards its base circle.

The lash adjuster 24 is operated in a known manner by oil at a pressure of approximately 30 psi to automatically adjust for lash between the parts. A channel through the top of the plunger also supplies lubricating oil through the stepped diameter annulus 63 surrounding a portion of plunger 52 to act on a flange 64 at the rear of the plunger. The force of spring 56 normally is strong enough to oppose the fluid force. However, when desired to establish a deactivating mode of the rocker arm, the oil pressure from the lash adjuster is increased to approximately 50 psi. This is sufficient to compress spring 56 and move the latching pin 52 rightwardly to withdraw it from the path of movement of the inner arm. The inner arm is then free to pivot on the axle pin 30 and move downwardly under the influence of the cam lobe without movement of outer body 12 and, therefore, without movement of valve stem 20.

FIGS. 2–5 illustrate the preferred embodiment of the invention in which a roller 68 replaces the sliding surface of FIG. 1, and a pair of helical torsion springs 70 replace the compression spring bucket follower 38 to maintain integrity between outer body 12 and inner arm 26.

More specifically, FIGS. 2–5 show an inner arm 26' pivotally connected to the yoke-shaped end 14' of outer body 12' on an axle 30' located at the valve stem end of arm 26'. A pair of helical torsion springs 70 are symmetrically fitted over each end of the axle 30', with the free ends 71 being grounded in a groove 72 in a ramp 73 (FIG. 5) formed on either side of the body 12'. The symmetrical arrangement of the springs essentially eliminates any twisting due to inertial forces.

Figure 6:
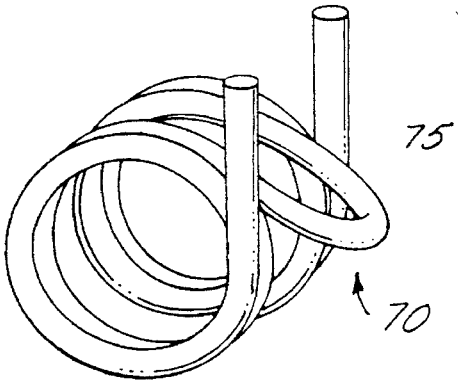
Figure 7:
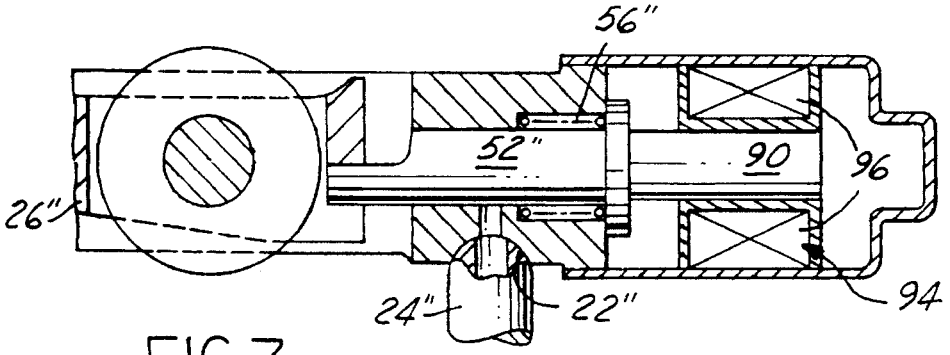
FIG. 7 is a cross-sectional view of a further embodiment of the invention.

The opposite end portion 74 of each spring is positioned underneath the inner arm 26' biasing it upwardly against the cam lobe. FIG. 6 shows an alternate one-piece torsion spring 70" with a connected center portion 75 that could be substituted for the two separate springs 70.

Figure 3:
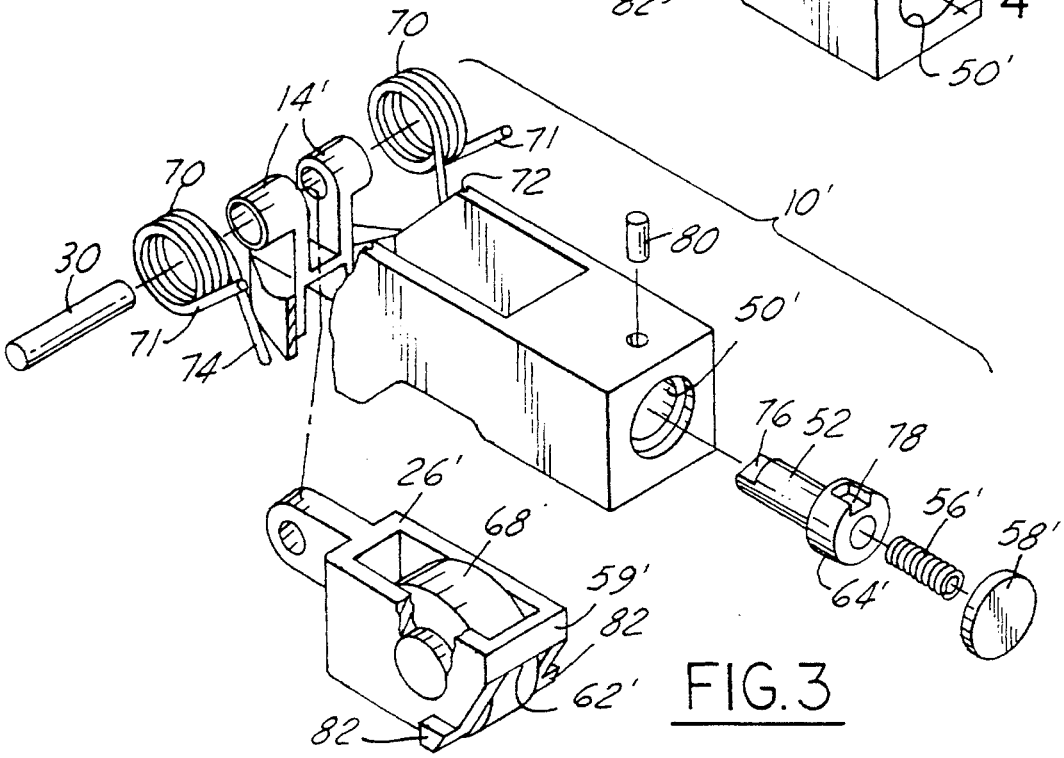
FIG. 3 is an exploded view of the embodiment shown in FIG. 2.
Figure 4:
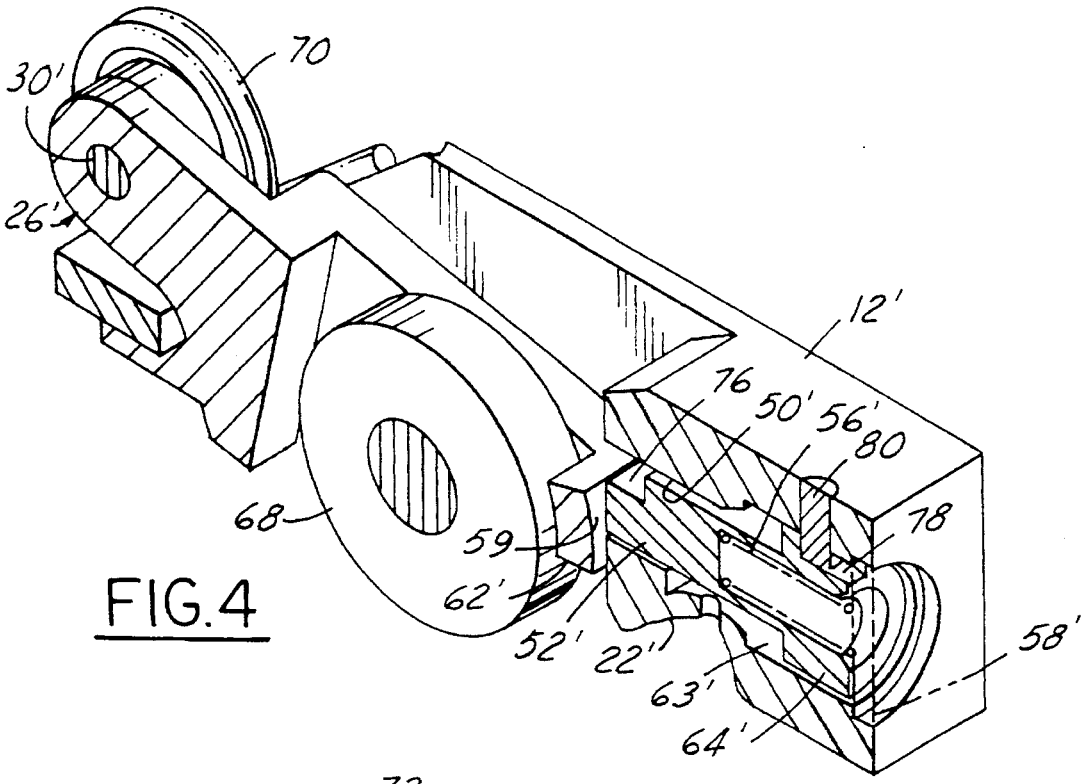
FIG. 4 is an enlarged cross-sectional view taken on a plane indicated by and viewed in the direction of the arrows IV—IV of FIG. 2.
Figure 5:
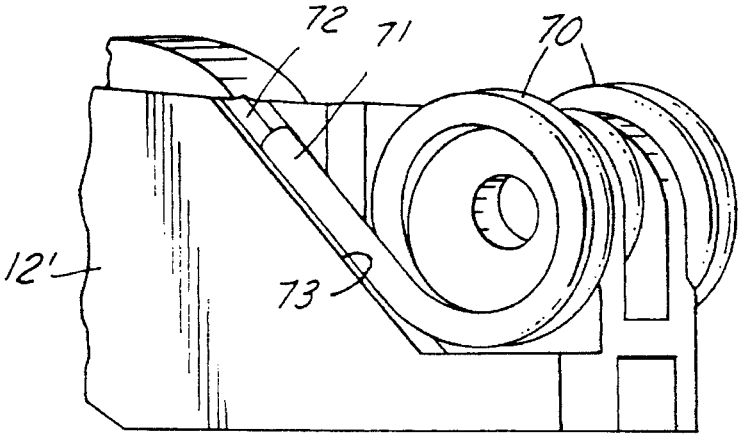
FIGS. 5 and 6 are views of details of the FIG. 4 showing.

As best seen in FIGS. 3–4, the inner arm 26' rotatably supports a roller 68 on an axle mounted in the sides of the arm, for an essentially friction free rolling engagement with the cam lobe, in contrast to that of the sliding surface of FIG. 1. Body 12' contains a bore 50' at the end opposite the valve stem, with a fluid annulus 63' and a latching pin or plunger 52'. A spring 56' biases the plunger pin inwardly towards the inner arm 26' to a latching position, and is seated against the bore end plug 58', shown in phantom. The front or left-hand end of the pin is again formed with a horizontal flat surface 76 for a mating engagement with the flat underside 62' of the depending edge of inner arm 26'. The top surface of plunger 52' has an axial keyway 78 cooperating with a peg or key 80 to prevent rotation of plunger 52' and thereby maintain the flat surfaces properly oriented and aligned.

FIG. 4 shows the arm 26' in its downwardmost clockwise position, the position attained when the cam lobe is at its maximum distance. This position prevents the pin 52' from moving outwards to ride over the top surface 32 of the arm, which would prevent a normal return of the arm upwardly. The end portion 59' of the arm again is formed with a cylindrical surface 60'. The surface prevents the pin 52 from moving axially as the surface 59' of arm 26' pivots downwardly in a free-wheeling motion when pin 52' is retracted.

The fluid annulus 63' connects to the spherical socket 22' that receives the end of a hydraulic lash adjuster, not shown. The connecting passage from the lash adjuster supplies oil to the annulus 63' at approximately 30 psi to act on the pin flange 64' in opposition to the force of spring 56'. When engine valve deactivation is desired, the oil pressure is increased to approximately 50 psi, which is sufficient to overcome the force of spring 56' and move pin 52' back out of the path of movement of inner arm 26'. This allows the arm to "free-wheel" under the force of the cam lobe without effecting movement of body 12' or actuation of the valve stem.

To prevent pumping up of the lash adjuster when the cam lobe is on its base circle, the inner arm is formed with bumper pads 82 (FIGS. 2–3), one on each side at the bottom. The force of the helical torsion springs 70 are designed to be greater than the lash adjuster forces so that the upward forces of the helical springs move the pads 82 to bottom against the undersurface of body 12'. This maintains the two together with the roller 68 against the cam, preventing the pump up.

The operation of the FIGS. 2–5 construction is essentially the same as that described in connection with FIG. 1, and, therefore, is not repeated.

Figure 2:
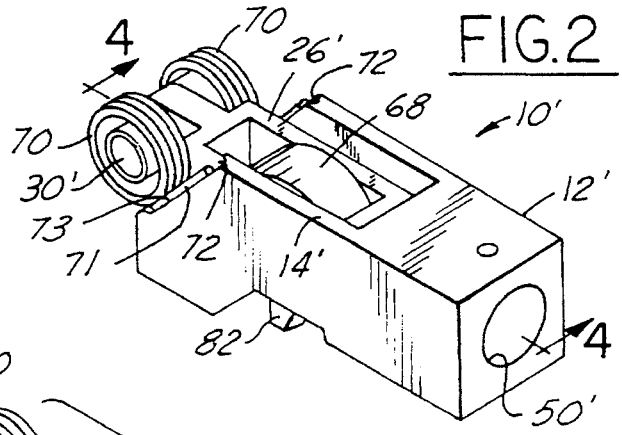
FIG. 2 is a perspective view of another embodiment of the invention.

FIGS. 7, 8, 8*a* and 9 show a modification to the embodiment of FIG. 2. In this case, the latching pin or plunger 52" is formed at its spring end with the armature 90 of an electromagnet assembly 94. It includes a solenoid 96 surrounding the armature which when energized moves the latching pin into the path of movement of the inner arm 26" to the locking position shown to prevent the inner arm from free-wheeling. This renders the outer body and inner arm essentially integral for operation of the rocker arm in a conventional manner to actuate the engine valve stem. Shutting off the current to the solenoid permits the spring 56" to push the plunger into the unlatching or valve disabling position.

Figure 8:
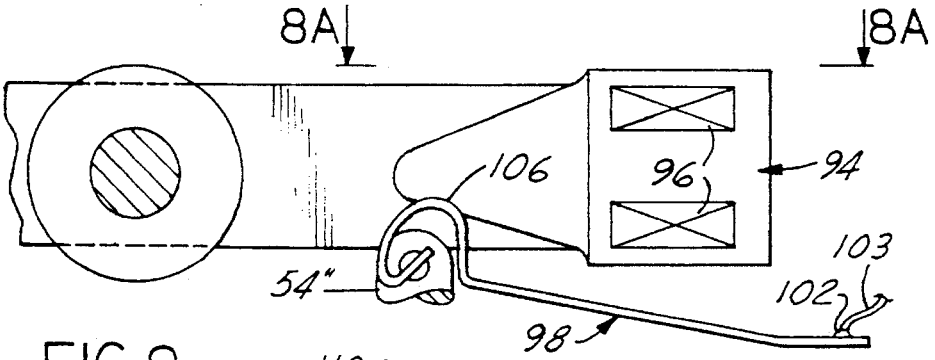
FIGS. 8 and 8*a* are side elevational and top views, respectively, of portions of the FIG. 7 construction.
Figure 8A:
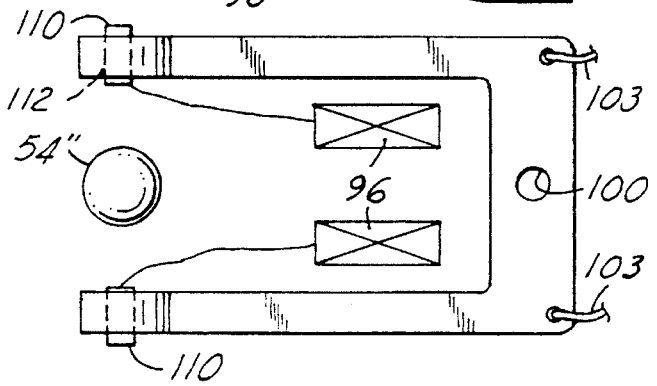
Figure 9:
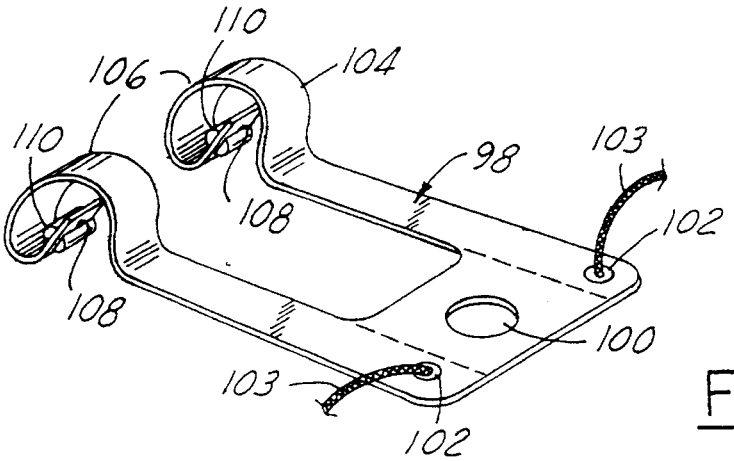
FIG. 9 is an enlarged perspective view of a detail of FIG. 8.

FIGS. 8, 8*a* and 9 illustrate the electrical connections to solenoid 96. It includes a flexible U-shaped spring steel electrical connector plate 98 having a hold down fastener hole 100 for a fixed or rigid attachment of this end. Wire connector terminals 102 are adapted to be connected by wires 103 to a source of electrical energy, not shown.

The opposite end 104 of plate 98 is yoke-shaped for assembly to opposite sides of the rocker arm. The ends 106 are curled as shown and received within grooves 108 in a pair of stationary pins 110. The pins would be positioned as close as possible to or on the axis of rotation of the lash adjustor fulcrum pivot 54". They would be fixedly mounted in a bore 112 (FIG. 8*a*) at right angles to the rocker arm pivot axis through the spherical socket 22" for lash adjuster 24".

The spring steel connector provides a positive joint between the inner arm and the pins 110, which rotate with the arm and with the arm move vertically, while the electrical connections remain fixed.

From the foregoing, it will be seen that the invention provides a rocker arm that in one mode operates as a conventional finger follower rocker arm to actuate an engine valve in known manner in response to rotation of the camshaft. An alternate mode allows the rocker arm to disable actuation of an engine valve. This is accomplished by the latching pin that is self-contained within the rocker arm. It normally effectively locks the parts of the rocker arm together for movement in one direction as an integral unit, but can be unlatched to permit the inner arm to free-wheel upon depression by the cam lobe without actuation of the main body of the rocker arm. Therefore, the valve does not move.

While the invention has been shown and described in its preferred embodiments, it will be clear to those skilled in the arts to which it pertains that many changes and modifications may be made thereto without departing from the scope of the invention.

We claim:

1. A self-contained engine camshaft cam lobe actuated finger follower type rocker arm assembly for drop-in installation in an engine, comprising, a longitudinally extending outer hollow body engagable adjacent one end with an engine valve stem for actuation thereof, moveable lash adjuster pivot fulcrum means adjacent the opposite end, and lost motion arm means pivotally mounted to and within the body adjacent the stem engaging body end, spring means urging the lost motion means into engagement with a rotatable cam lobe, means mounting the arm means for a pivotal arcuate movement of the arm means by the cam lobe relative to the body preventing actuation at times of the valve stem by the body upon movement of the arm means, and latch means wholly contained within the lash adjuster end of the body extending essentially parallel to the body longitudinal axis for movement in opposite directions, the latch means including a plunger means projectably movable longitudinally to a latch position into the path of arcuate movement of the arm means for engagement therewith thereby preventing relative movement between the body and the arm means in one direction to thereby transmit movement of the arm means by the cam lobe to the body for actuating the valve stem, the plunger means and arm means having engagable mating flat surfaces providing wide surface area contact when engaged while permitting limited sideways movement therebetween thereby minimizing contact stresses therebetween and the need for precise thrust surfaces.

2. An assembly as in claim 1, including torsion spring means between the arm means and the body biasing the arm means into continual engagement with the cam lobe, the spring means being arranged symmetrically on opposite sides of the pivot axis of the arm means to reduce twisting moments.

3. An assembly as in claim 2, including other spring means biasing the plunger means in one direction into the latching position, and fluid pressure means urging the plunger means in an opposite direction to an unlatching position.

4. An assembly as in claim 1, the spring means comprising helical torsion spring means, and bumper type stop means on the arm means engagable with the body at times for preventing movement of the body relative to the arm means in a direction towards the cam lobe while permitting movement of the arm means relative to the body in the opposite direction, with the lash adjuster fulcrum means biasing the body toward the cam lobe with a force which is less than the force exerted by the torsion spring means upon the body in a direction away from the cam lobe.

5. An assembly as in claim 1, including a keyway assembly operably connected to one of the arm means and plunger means assuring continual alignment of the mating flat surfaces for engagement therebetween.

6. An assembly as in claim 4, wherein the stop means comprises a pad projecting outwardly from a side portion of the arm means adjacent the bottom thereof for engagement with an underside portion of the body in response to the force of the helical spring means.

* * * * *